US005456165A

United States Patent [19]

Schockman et al.

[11] Patent Number: 5,456,165

[45] Date of Patent: Oct. 10, 1995

[54] METHOD FOR ADJUSTMENT IN MOTION OF PRESS SHUTHEIGHT

[75] Inventors: Robert L. Schockman, St. Henry; Bradley A. Burns, Wapakonete; Frederick C. Bergman, Coldwater; Edward A. Daniel, Fort Loramie, all of Ohio

[73] Assignee: The Minster Machine Company, Minster, Ohio

[21] Appl. No.: 327,865

[22] Filed: Oct. 24, 1994

Related U.S. Application Data

[62] Division of Ser. No. 49,951, Apr. 20, 1993, Pat. No. 5,398, 601.

[51] Int. Cl.[6] ..... B30B 13/00; B30B 15/14

[52] U.S. Cl. ..... 100/35; 72/21; 72/448; 83/530; 100/53; 100/257

[58] Field of Search ..... 100/35, 43, 53, 100/257; 72/21, 455, 446, 448; 83/527, 530

[56] References Cited

U.S. PATENT DOCUMENTS

| | | | |
|---|---|---|---|
| 2,984,175 | 5/1961 | Wahl | 100/257 |
| 3,178,983 | 4/1965 | Brunson | 83/530 |
| 3,858,432 | 1/1975 | Voorhees et al. | 72/455 |
| 4,030,336 | 6/1977 | Grigorenko et al. | 72/432 |
| 4,135,446 | 1/1979 | Bareis et al. | 100/257 |
| 4,150,618 | 4/1979 | Spanke et al. | 100/257 |
| 4,206,699 | 6/1980 | Hemmelgarn | 100/53 |
| 4,206,701 | 6/1980 | Hemmelgarn | 100/257 |
| 4,464,916 | 8/1984 | Grew et al. | 72/17 |
| 4,677,908 | 7/1987 | Imanishi et al. | 100/53 |
| 4,785,732 | 11/1988 | Czapka et al. | 100/257 |
| 4,790,173 | 12/1988 | Boutcher, Jr. | 72/446 |
| 4,918,956 | 4/1990 | Schoch | 72/21 |

FOREIGN PATENT DOCUMENTS

| | | | |
|---|---|---|---|
| 52-76781 | 6/1977 | Japan | 100/257 |
| 63-144900 | 6/1988 | Japan | 100/257 |
| 63-299900 | 12/1988 | Japan | 100/257 |
| 4-112999 | 4/1992 | Japan | 100/257 |
| 590152 | 1/1978 | U.S.S.R. | 100/257 |

*Primary Examiner*—Stephen F. Gerrity
*Attorney, Agent, or Firm*—Baker & Daniels

[57] ABSTRACT

A shutheight adjustment mechanism of a mechanical press including a piston member restrained from moving vertically by a sealed liquid-filled chamber of relatively short height. The chamber acts as a stiff liquid-spring that limits deflection and movement of the piston member and ultimately the slide or bolster. Seals define the chamber to assure that the chamber is filled with liquid. The liquid-filled chamber damps free movement between parts thereby helping to resist changes in shutheight. Liquid also is injected between the piston member and both the adjustment nut and the housing. This liquid reduces torque requirements for shutheight adjustment.

3 Claims, 3 Drawing Sheets

METHOD FOR ADJUSTMENT IN MOTION OF PRESS SHUTHEIGHT

This is a division of application Ser. No. 08/049,951, filed Apr. 20, 1993, (U.S. Pat. No. 5,398,601).

BACKGROUND OF THE INVENTION

The present invention relates generally to mechanical presses and in particular to a shutheight adjustment mechanism, wherein punching and snapthrough loads through the shutheight adjustment mechanisms are more accurately controlled.

Mechanical presses, for example, stamping presses and drawing presses, comprise a frame having a crown and bed and a slide supported within the frame for motion toward and away from the bed. The slide is driven by a crankshaft having a connecting arm connected to the slide.

Such mechanical presses are widely used for stamping and drawing operations and vary substantially in size and available tonnage depending upon the intended use.

In prior art presses of this type, the slide is generally connected to the crankshaft by a connecting rod which is adjustable in length or which is connected to another member, such as a connection screw that is adjustable in its relation to the slide so that the shutheight opening between the slide and the bed can be adjusted to accommodate various die sets. Alternatively, the bed portion or bolster of the press may have its position adjusted relative to the slide so as to adjust the shutheight therebetween, as disclosed in U.S. Pat. No. 3,858,432. Regardless of the mode of shutheight adjustment, the slide is generally guided on the uprights of the press frame extending between the crown and the bed so that the parts of the die set remain in accurate registration as the slide reciprocates.

Many prior art mechanical presses include a plurality of connection screw assemblies for reciprocating the slide and it is customary practice to provide a shutheight adjustment mechanism whereby the position of the slide relative to each of the connection screws adjusted simultaneously by means of an interconnected worm and worm gear arrangement, which is driven either manually or by means of an operator controlled motor.

Prior problems with shutheight adjustment mechanisms include the transfer of punching and snapthrough loads through the adjustment mechanisms during press operation. A press load is the load created by the mechanical press when the slide is urging its associated die into contact with the work piece. When the work piece fractures in the die, the slide attempts to rapidly accelerate downward i.e. snapthrough. This snapthrough load is comprised mainly of this downward acceleration of the die and slide combination. These loads, if not compensated for, cause changes in shutheight.

A problem with shutheight adjustment mechanisms disposed in press bolsters is that of rebound. Rebound is motion of the bolster top surface caused by a rebounded or reflected pressure wave formed by the operation of the press. Press rebound is similar to snapthrough, but that the bolster will suddenly accelerate, thereby causing changes in shutheight.

A particular problem for accurately controlling press shutheight is the tolerances and spaces between the connected portions of the press, and specifically the connections of the shutheight adjustment mechanism to the slide or bolster. Shutheight adjustment mechanisms require certain clearances between the parts during the manufacture, assembly, and adjustment so that the worm gear, adjustment nuts, and connection screws may turn and move so that they may operate. These same clearances between the parts cause a problem during press use, since the clearances increase the possible ranges of shutheight during press operation.

The clearances also prevent the even transmission of pressure loads through the press. This uneven transmission of forces may cause particular parts, undergoing concentrated impact forces, to fail. Again, the clearances between the parts permit the shutheight to variably change during operation of the press resulting in workpieces that may not meet design specifications.

The present invention is directed to overcome the aforementioned problems associated with mechanical press shutheight adjustment mechanisms wherein it is desired to accurately control shutheight while increasing protection of the shutheight adjustment mechanisms.

SUMMARY OF THE INVENTION

The present invention provides a shutheight adjustment mechanism including an assembly for restraining undesired deflection or movement due to punching, snapthrough and/or inertia forces. This is accomplished by attaching a sealed liquid-filled chamber of relatively short height to the adjustment mechanism. This chamber acts as an extremely stiff "liquid-spring" or "oil-spring" that limits deflection and/or movement of the slide or bolster face.

The shutheight adjustment mechanism is permitted to operate while the press is cycling. This is termed adjustment-in-motion.

An advantage of the shutheight adjustment mechanism of the present invention is that the liquid-filled chamber damps free movement between parts, helping to resist changes in dynamic shutheight. This resistance to changes in shutheight permit the press to create workpieces with smaller tolerances.

Another advantage of the present invention is that clearance spaces between the adjustment nut, piston, and housing are filled with oil to reduce torque requirements during shutheight adjustment while the press is operating.

A further advantage of the shutheight mechanism of the present invention is that the trapped oil helps reduce punch penetration resulting in a dynamically stiffer press die set thereby correspondingly increasing die life. By more accurately controlling shutheight, accidental impacts between the dies are reduced.

The invention, in one form thereof, provides a press with a frame structure having a crown and bed, with a slide guided by the frame structure for reciprocating in opposition to the bed. A bolster assembly is mounted to the bed of the press. A shutheight adjustment mechanism is attached onto the bolster assembly to adjust the shutheight between the bolster and slide. The mechanism has a male threaded member threadably engaging a female threaded member. A piston, attached to the male threaded member, forms a liquid-filled sealed chamber in association with a piston housing. This liquid-filled chamber restrains upward deflection and/or movement of the piston and its attached bolster top surface.

In one form of the invention, the shutheight adjustment mechanism includes a feedback means to measure the shutheight and automatically change the shutheight to a predetermined shutheight.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
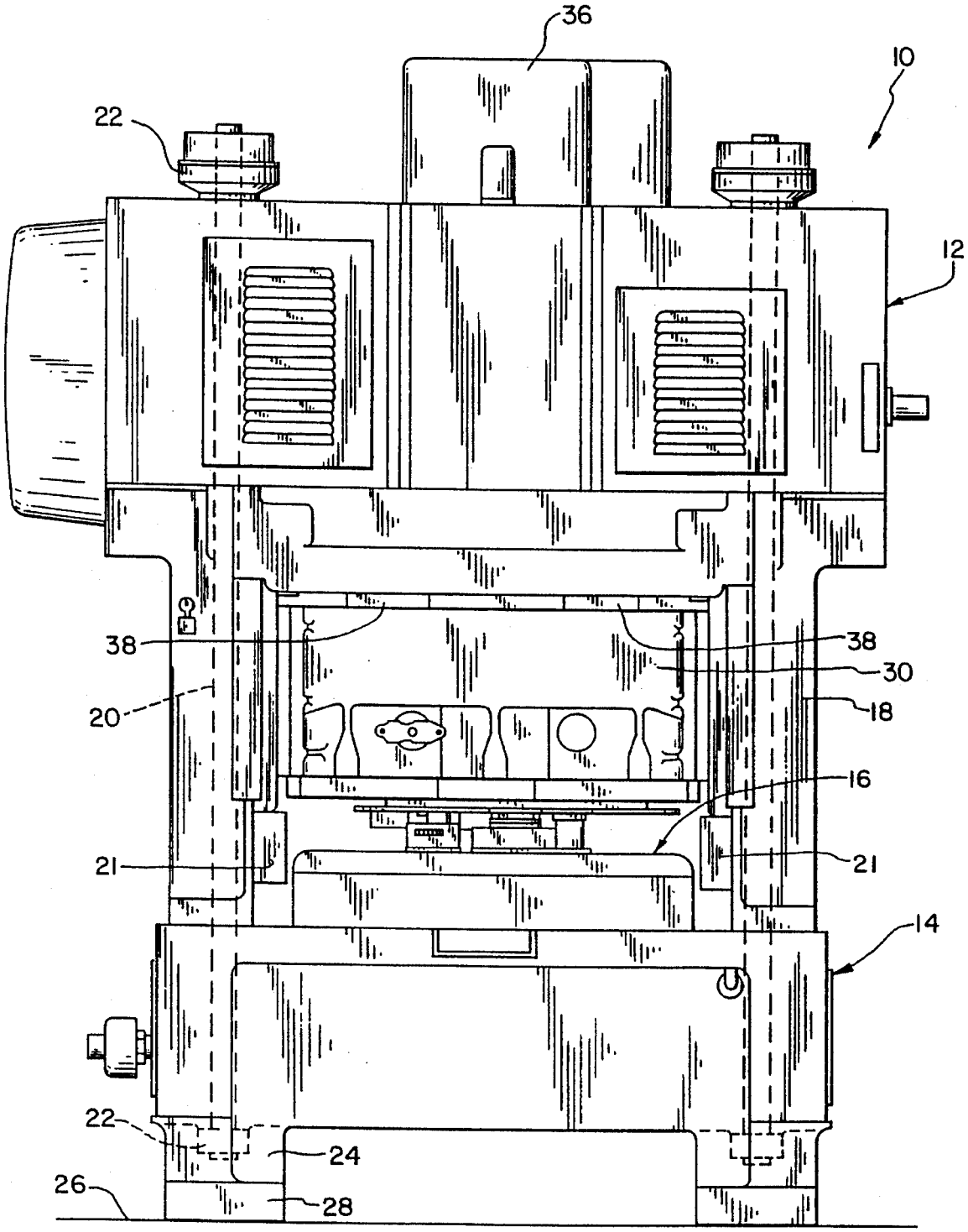
FIG. 1 is a front elevational view of a mechanical press incorporating the shutheight adjustment mechanism of the present invention.

Referring now to FIG. 1, mechanical press 10 comprises a crown portion 12, a bed portion 14 having a bolster assembly 16 connected thereto and uprights 18 connecting crown portion 12 with bed portion 14. Uprights 18 are connected to or integral with the underside of crown 12 and the upper side of bed 14. Tie rods 20 extend through crown 12, uprights 18 and bed portion 14 and are attached on each end with tie rod nuts 22. Leg members 24 are formed as an extension of bed 14 and are generally mounted on the shop floor 26 by means of shock absorbing pads 28. A drive means such as motor 36 is connected by means of connecting rods 38 to slide 30 to cause the slide to reciprocate in opposed relationship to the bed as is known in the art.

Press shutheight is controlled in a known manner by first measuring the shutheight between slide 30 and bolster 16 by a shutheight measuring means 21 such as a limit switch, an accelerometer or a non-contacting optical or electrical sensing means as is known in the art. The shutheight adjustment mechanism is then activated to change the measured shutheight to a desired shutheight. The present invention is directed to improve current shutheight adjustment mechanisms thereby permitting more accurate shutheight adjustment while press 10 is cycling.

The present invention comprises creating a sealed liquid-filled chamber of relatively short height attached to the adjustment screw to prevent deflection or movement of the bolster face during press cycling. Although oil is the preferred liquid used in the chamber, other hydraulic fluids may be used.

Figure 2:
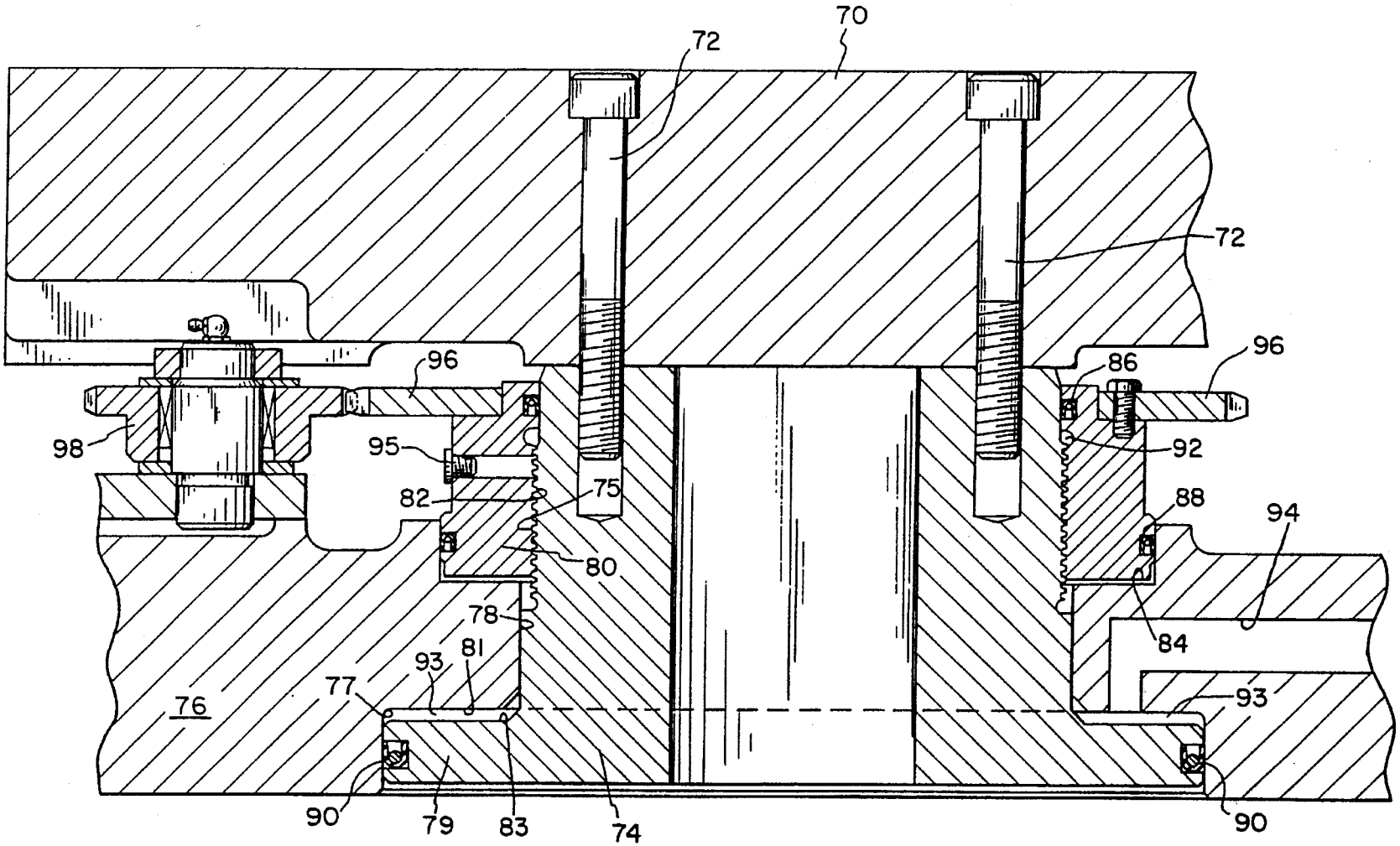
FIG. 2 is an enlarged fragmentary sectional view of an adjustment mechanism for a bolster incorporating the present invention.

FIG. 2 illustrates this concept with the mechanism shown imbedded in bolster 16. A bolster top face plate 70 is attached by means of bolts 72 to a lock piston 74. A bolster housing 76 is attached to bed 14. Bolster housing 76 includes a cylinder bore 78 in which lock piston 74 slides.

An adjustment nut 80, having threads 82, is threadedly engaged about lock piston threads 75. Adjustment nut 80 engages recess 84 concentrically, with cylinder bore 78, thereby providing a place into which attachment nut 80 may sealingly rotate. A clearance space exists between adjustment nut threads 82 and lock piston threads 75 to permit relative rotation. During operation, this clearance space is filled with liquid, normally oil. By filling this clearance space with liquid, torque requirements for rotation and subsequent shutheight adjustment are reduced. Also, fretting and wear of the threads are reduced. The clearance space may extend about adjustment nut 80, to lie between bolster housing 76 and adjustment nut 80 (FIG. 2). The clearance space may receive the oil, for instance, from oil chamber 93 or oil passage 94 to be discussed below.

The shutheight adjustment mechanism shown in FIG. 2 utilizes an oil-spring chamber effect between the lock piston 74 and bolster housing 78. Cylinder bore 78 includes a larger counterbore section 77 into which an enlarged portion 79 of piston 74 sealably engages. Enlarged portion 79 of piston 74 includes a surface 83 which lies opposite the bottom surface 81 within counterbore section 77. Between surface 83 and surface 81 is formed a sealable chamber 93.

Figure 3:
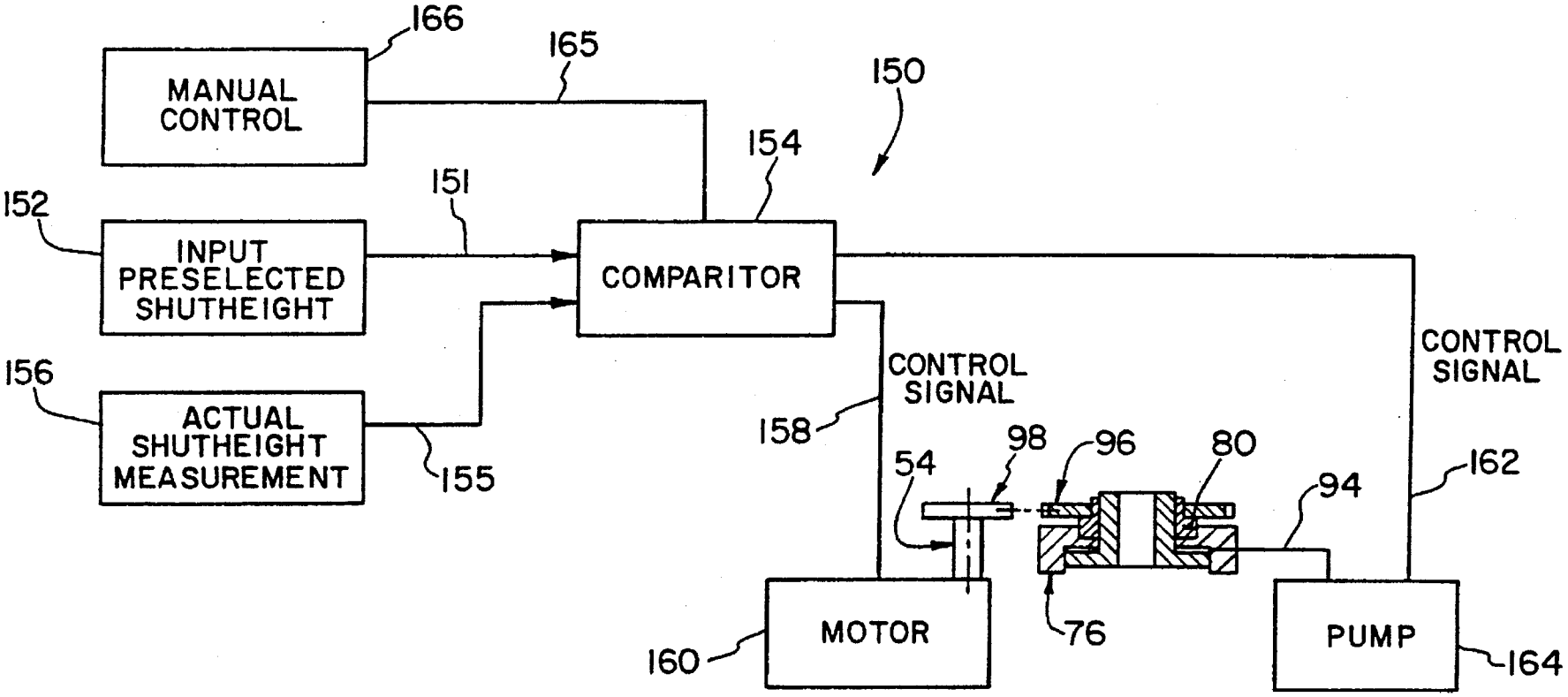
FIG. 3 is an exemplary diagrammatic arrangement of an automatic feedback means usable with the present invention.

Chamber 93 is filled by a liquid, preferably oil, from an oil supply tube 94. Oil supply tube 94 is connected to an oil injecting means such as pump 164 as shown in FIG. 3.

During normal operation, the distance between surface 83 and surface 81 is approximately 0.03 inches to 0.25 inches. This short distance provides an adequate thickness for the oil pool to substantially dampen movement of lock piston 74 during press operation. Alternatively, other thicknesses may be used depending on the circumference of chamber 93 and the viscosity and other characteristics of the liquid injected into chamber 93.

Seal 86 on adjustment nut 80, seals chamber 93 between adjustment nut 80 and piston 74. Another seal 88 seals between adjustment nut 80 and bolster housing 76 within recess 84. Lock piston 74 also includes sidewall seal 90 sealing against cylinder bore 78. The three seals 86, 88, and 90 seal the chamber 93 formed between adjustment nut 80, lock piston 74, and bolster housing 76.

An oil passage 94 runs through bolster housing 76 to communicate pressurized or non-pressurized oil from an oil source (not shown). For purposes of this application, non-pressurized oil is defined to mean oil that is at atmospheric pressure. An example would be oil sitting in an open drum exposed to the atmosphere. Pressurized oil is defined to mean oil at pressures greater than atmospheric pressure. The oil fills the chamber 93 between adjustment nut 80 and both lock piston 74 and bolster housing 76. Adjustment nut 80 may contain a bleeder fitting 95 to bleed trapped air out of chamber 93.

In operation, the shutheight adjustment mechanism, as shown in FIG. 2, reduces bolster "bounce" or rebound during operation. Oil within chamber 93 creates a force to urge piston 74, along with adjustment nut 80 and bolster 70, in a downward direction thereby pulling the assembly closer to the bolster housing 76 at all times. This reduces free clearance between the parts and preloads them prior to press operation. The anti-rebound effects are enhanced by pressurizing the oil within chamber 93.

Although only one adjustment mechanism is shown in FIG. 2, normally a press 10 would contain a plurality of such shutheight adjustment mechanisms. Each adjustment nut 80 includes a sprocket 96 to which a drive sprocket 98 would be drivingly engaged. Sprocket 98 is driven by a hydraulic motor 160 (FIG. 3). This motor 160 would be a high ratio drive motor, as is known in the art, to allow very accurate radial positioning of sprocket 96. Alternatively, sprocket 96 could be driven by sprocket 98 through an interfit drive chain or belt.

Adjustment of press shutheight during press operation is conducted by rotation of adjustment nut 80 through means of motor 160. Oil within chamber 93 creates a pre-load condition that causes bolster surface 70 to be pulled tighter and closer to bolster housing 76. This preload reduces shutheight deviation and movement of the shutheight adjustment during press operation.

The present invention is not limited to shutheight adjustment mechanisms located within the slide or bolster portions of a press. Depending upon the size of press 10 and the required tonnage, different locations for shutheight adjustment are possible.

The feedback means for automatically controlling the shutheight will be discussed in relation to FIG. 3. However, it is understood and appreciated that alternative control arrangements may be utilized to control the set shutheight.

Automatic control of shutheight is maintained by a control or feedback means 150 as shown in FIG. 3. Prior to operation, the press operator inputs a preselected shutheight 152 through line 151 into the comparator 154. Feedback means 150 along with comparator 154 may comprise a microprocessor as known in the art. Comparator 154 receives input signals and provides output or control signals as a function of its inputs.

Shutheight measuring means 21 of FIG. 1 transmits an actual shutheight measurement 156 during press operation. Comparator 154 compares the difference between the preselected shutheight 152 and the actual shutheight 156 and forms a control signal on line 158 to control motor 160 and another control signal on line 162 to an oil pressurizing means such as oil pump 164. Pump 164 connects to chamber 93 via oil line 94 to inject and/or pressurize the oil therein. The results of the comparison between preselected shutheight 152 and the actual shutheight measurement 156 causes comparator 154 to vary the control signal in line 158 to control motor 160 to rotate control motor 160 forward or reverse. As shown in FIG. 3, control motor 160 is connected to rotatable shaft 54 and sprocket 98 and sprocket 96 to cause rotation of adjustment nut 80. As shown in FIG. 3, comparator 154 may be overridden via a manual control circuit 166 along a line 165 for direct operator control of control motor 160 and pump 164.

Comparator 154, based on its inputs, may vary control signal on line 162 to pump 164 to vary the volume and pressure of oil pumped by pump 164. In this fashion, oil within chamber 93 may be changed in pressure and flow during press operation and/or during shutheight adjustment.

Alternatively, instead of the comparator 154 being constructed from a microprocessor, a programmable logic controller may be utilized as is known in the art.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of restraining deflection and movement in press shutheight adjustment mechanisms on a press having a frame with a crown and a bed, a slide guided by the frame structure for reciprocating movement in opposed relation to said bed, a bolster assembly mounted to said bed, a shutheight adjustment mechanism attached to the press to adjust the shutheight between the slide and the bolster, the mechanism comprising a piston member and an adjustment nut in a threaded engagement, said piston member and said adjustment nut having a clearance space therebetween within said threaded engagement, the mechanism having at least two portions that form a chamber between themselves of short height, said method comprising:

filling said clearance space with liquid whereby the torque necessary for rotation of said adjustment nut relative to said piston member is reduced; and filling said chamber with liquid whereby a stiff liquid-spring is created that restrains deflection and movement of the shutheight adjustment mechanism.

2. The method of claim 1 further comprising the step of sealing said liquid within said chamber by seals.

3. The method of claim 1 further comprising the step of providing fluid communication between said chamber and said clearance space.

* * * * *